US005296664A

United States Patent [19]

Crookston et al.

[11] Patent Number: 5,296,664

[45] Date of Patent: Mar. 22, 1994

[54] CIRCUIT BREAKER WITH POSITIVE OFF PROTECTION

[75] Inventors: Ronald W. Crookston, Penn Township, Westmoreland County; Douglas C. Marks, Trafford; David C. Turner, North Fayette; Richard E. White, III, Brighton Township, Beaver County; Steven Castelein, Sewickley, all of Pa.

[73] Assignee: Westinghouse Electric Corp., Pittsburgh, Pa.

[21] Appl. No.: 976,636

[22] Filed: Nov. 16, 1992

[51] Int. Cl.[5] ..... H01H 23/00

[52] U.S. Cl. ..... 200/401; 200/DIG. 42; 335/172

[58] Field of Search ..... 200/401, DIG. 42, 400, 200/43.14, 43.15, 43.11; 335/172, 176

[56] References Cited

U.S. PATENT DOCUMENTS 5,213,206 5/1993 Beck et al. ..... 200/401

*Primary Examiner*—Henry J. Recla
*Assistant Examiner*—David J. Walczak
*Attorney, Agent, or Firm*—M. J. Moran

[57] ABSTRACT

A positive off mechanism for a circuit breaker includes a pair of positive off levers slideable in slots in the side plates and extendable into the path of the operating handle to prevent movement of the handle to the off position when the contacts are welded closed. The positive off levers are actuated by positive off links pivotally mounted to the side plates and coupled to the positive off levers by "dog bone" connections. The positive off links in turn are actuated by the toggle mechanism of the circuit breaker which collapses to open the contacts during normal circuit breaker operation, but which remains erect when the contacts are welded closed.

13 Claims, 6 Drawing Sheets

CIRCUIT BREAKER WITH POSITIVE OFF PROTECTION

BACKGROUND OF THE INVENTION

1. Field of the Invention

This invention is directed to circuit breakers and in particular to circuit breakers having mechanisms which prevent movement of the circuit breaker operating handle to the off position if the contacts are welded closed.

2. Background Information

A common type of circuit breaker has a fixed electrical contact, and a movable electrical contact mounted on a movable contact arm. The contacts are closed and opened by rotating a handle between an on and off position, respectively. A latchable cradle connected to the movable contact arm by a spring operated toggle device is held in a latched position by a trip device. In response to predetermined overload conditions in the circuit breaker, the trip mechanism unlatches the latchable cradle and the spring operated toggle device rotates the movable contact arm to open the contacts. When the circuit breaker is tripped in this manner, the spring operated toggle device also moves the handle to a trip position intermediate the on and off positions. Thus, the handle provides a visual indication of the state of the circuit breaker. The circuit breaker is reset by moving the handle slightly past the off position to relatch the latchable cradle, and then to the on position to reclose the contacts.

It is possible under some overload conditions for the contacts of a circuit breaker to become welded closed. Under these circumstances, the trip device of the circuit breaker described above can respond to the overload condition by unlatching the latchable cradle. However, if the weld is of sufficient strength, the contact arm cannot be rotated and the contacts remain closed. Still, it may be possible to rotate the handle to the off position. Furthermore, in some installations, the circuit breaker is operated by a motor operator or a mechanical linkage which can force the operating handle to the off position even though the contacts are welded closed. Obviously, this is a very unsatisfactory situation.

Various remedies for the above condition have been proposed. Some of these solutions are not satisfactory because the operating mechanisms have a considerable number of moving parts, so that despite interlocks designed to prevent movement of the handle to the off position when the contacts are welded, the mechanism can be distorted or parts can even be bent to force the handle to the off position. In fact, some codes require that the device be able to withstand forces up to three times the normal operating force.

There is a need therefore for an improved positive off mechanism for a circuit breaker which is rigid enough to block movement of the operating handle to the off position despite the application of a force to the operating handle which is in excess of the normal operating force required to operate the circuit breaker.

SUMMARY OF THE INVENTION

This need and others are satisfied by the invention which is directed to a circuit breaker having positive off levers slideable in slots in the side plates which support the circuit breaker mechanism. These positive off links are slideable in these slots in the side plates between an extended position in which they positively block the movement of the operating member handle, and a retracted position which allows movement of the operating handle to the required position.

The positive off levers are actuated by positive off links which in turn are actuated by the toggle mechanism of the circuit breaker. More specifically, the positive off links are U-shaped members pivotally mounted to the side plates adjacent the slots carrying the positive off levers. The arms of the U-shaped positive off links straddle the crossbar of the toggle mechanism. During normal operation of the circuit breaker, when the handle is moved to the open position, the toggle mechanism collapses to open the contacts and the crossbar engages one of the arms of the positive off links to retract the positive off lever. When the circuit breaker is again turned on, the crossbar engages the other arm of the positive off links to extend the positive off levers. When the circuit breaker contacts are welded closed, the toggle mechanism does not collapse and therefore the positive off levers remain extended into the path of the operating member, thereby preventing the handle from being moved to the open position. While the handle cannot be moved to the open position, it can be moved sufficiently to the toggle position of the toggle mechanism so that the toggle mechanism applies a force tending to break the weld. However, since the positive off levers transmit forces applied to the handle directly into the side plates when the positive off levers are engaged, excessive force cannot be. applied to the operating mechanism which, in some prior art circuit breakers, causes deflection of the mechanism and defeat of the positive off mechanism.

The invention also includes stops on the moveable contact arms which prevent deflection of the toggle mechanism to the point where the handle toggle position could be reached. Thus, the handle can not only not be moved to the off position, but will return to the on position when released to provide a positive indication that the contacts remain closed.

The invention further includes a "dog bone" coupling between the positive off levers and the positive off links. A circular terminal portion on the positive off levers is captured in a re-entrant, circular recess in the positive off link to provide the pivotable coupling.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

The invention will be described as applied to a Westinghouse Series C, N-frame, molded case circuit breaker. However, it will be appreciated by those of ordinary skill in the art that the principles of the present invention are applicable to various types of molded case circuit breakers. Moreover, for simplicity, only the center pole of a multiple pole molded case circuit breaker is described in detail and illustrated.

A full description of an ND molded case circuit breaker is presented in commonly owned, copending U.S. Pat. application Ser. No. 07/779,441 entitled MOLDED CASE CURRENT LIMITING CIRCUIT BREAKER filed on Oct. 18, 1991 in the names of R. Crookston, D. C. Marks, R. E. White III, B. E. Beatty, S. Castelein, and Y. Chien which is hereby incorporated by reference. Only a general description and details of those components related to the present invention will be described herein.

Figure 1:
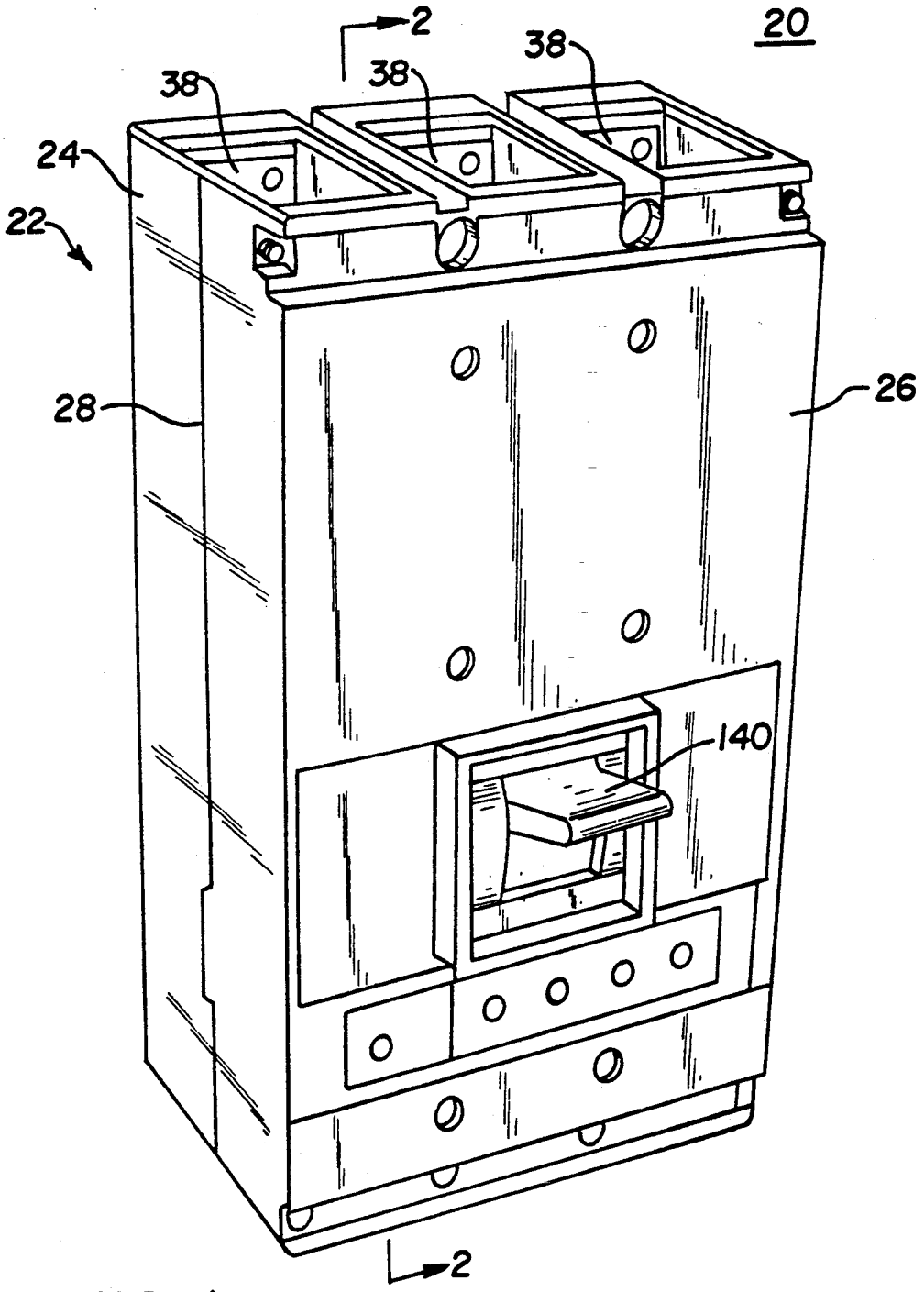
FIG. 1 is a perspective view of a circuit breaker incorporating the invention.

Referring to the drawings and in particular to FIG. 1, a molded case circuit breaker, generally identified with the reference numeral 20, comprises an insulated housing 22, formed from a molded base 24 and a molded cover 26, assembled at a parting line 28. The circuit breaker 20 also includes at least one pair of separable main contacts 30 (FIGS. 2–5), provided within the insulated housing 22, which includes a fixed main contact 32 and a movably mounted main contact 34. The fixed main contact 32 is carried by a line side conductor 36, rigidly secured to the molded base 24. The line side conductor 36, in turn, is electrically connected to a line side terminal 38 (FIG. 1) for connection to an external electrical circuit (not shown).

In order to decrease the wear on the separable main contacts 30, a plurality of arcing contacts 40 are provided (FIGS. 2–5). The arcing contacts 40 include one or more fixed arcing contacts 42 and one or more movably mounted arcing contacts 44. A mechanical coupling between the movably mounted arcing contacts 44 and the movably mounted main contacts 34 allows the arcing contacts 40 to close before the separable main contacts 30 when the circuit breaker 20 is placed in an ON position and allows the arcing contacts 40 to open after the main contacts 30 when the circuit breaker 20 is placed in an OFF position.

The separable main contacts 30 and arcing contacts 40 are carried by a movable contact arm assembly 46. The contact arm assembly 46 includes a plurality of main contact arms 48, for example six, and a pair of arcing contact arms 50 for carrying the movably mounted main and arcing contacts 34 and 44, respectively. The contact arm assembly 46 also includes a 2-piece carrier assembly 52 comprising an inner carrier 54 and an outer carrier 56 pivotally connected together. The carrier assembly 52 in turn is pivotally mounted on the molded base 24 by pin 58. With the 2-piece carrier assembly 52, magnetic repulsion forces generated during relatively high overcurrent conditions blow the contacts open prior to operation of the normal operating mechanism which will be described below.

Figure 2:
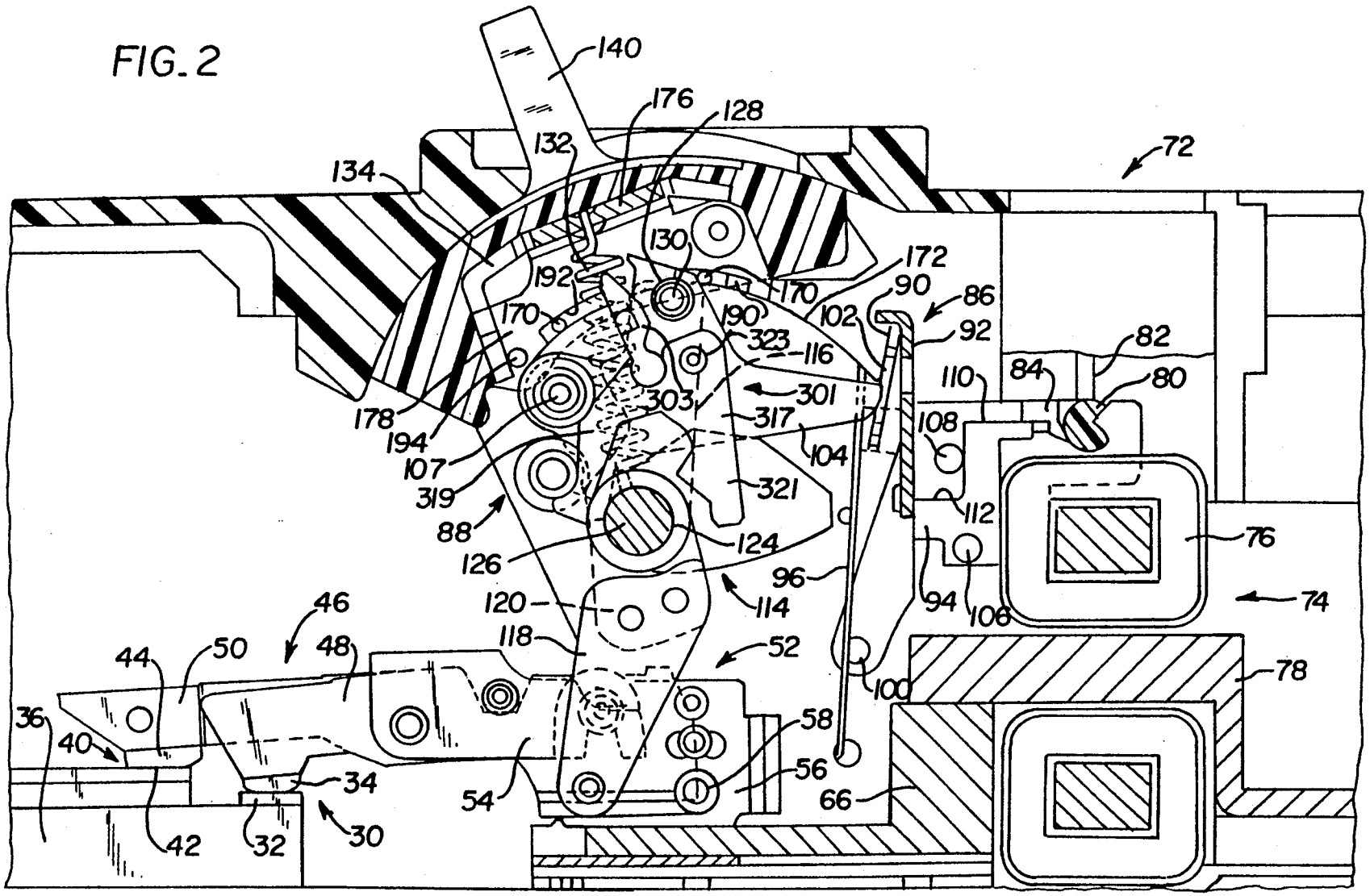
FIG. 2 is a vertical section through the circuit breaker of FIG. 1 taken along the line 2—2 and showing the breaker in the ON or CLOSED position.

The movable contact arm assembly 46 is connected to a load conductor 66 by a series of flexible shunts (not shown). Disposed adjacent the load conductor 66 is an electronic trip unit 72 (FIG. 2). The electronic trip unit 72 does not form a portion of the present invention and is described briefly only to provide a better understanding of the invention. Such electronic trip units are generally known in the art. For example, one known electronic trip unit is disclosed in U.S. Pat. No. 3,783,423, hereby incorporated by reference.

The electronic trip unit 72 includes a current transformer 74 for each phase for sensing load current. The current transformers 74 are formed in a generally donut shape with a plurality of secondary windings 76 disposed about a load conductor 78.

The load conductor 78 is formed in a generally L-shape and is rigidly secured on one end to the load conductor 66 as well as to the molded base 24 with a plurality of fasteners (not shown). The free end (not shown) of the load conductor 78 acts as a load terminal for connection to an external load, such as a motor.

When the main contacts 30 are in an ON position as shown in FIG. 2, the load current flows from the line side conductor 36 through the main contacts 30 and the arcing contacts 40 to load side conductors 66 and 78 to the electrical load. The load current through the load conductor 78 induces a current into the secondary windings 76 of the current transformer 74. The current in the secondary windings 76 is, in turn, applied to overcurrent trip circuitry (not shown) disposed within the electronic trip unit 72 for initiating a trip of the circuit breaker 20 for predetermined levels of overcurrent. More specifically, the electronic trip unit 72 includes a trip bar 80 (FIG. 2) having an integrally formed extending trip lever 82. The trip lever 82 is mechanically coupled to a flux shunt trip assembly (not shown) which cooperates to rotate the trip bar 80 in a clockwise direction (FIG. 2) during predetermined levels of overcurrent. Upon rotation of the trip bar 80, a latch lever 84, integrally formed on the trip bar 80, releases a latch assembly 86 to allow the circuit breaker 20 to trip.

Latch Assembly

Figure 3:
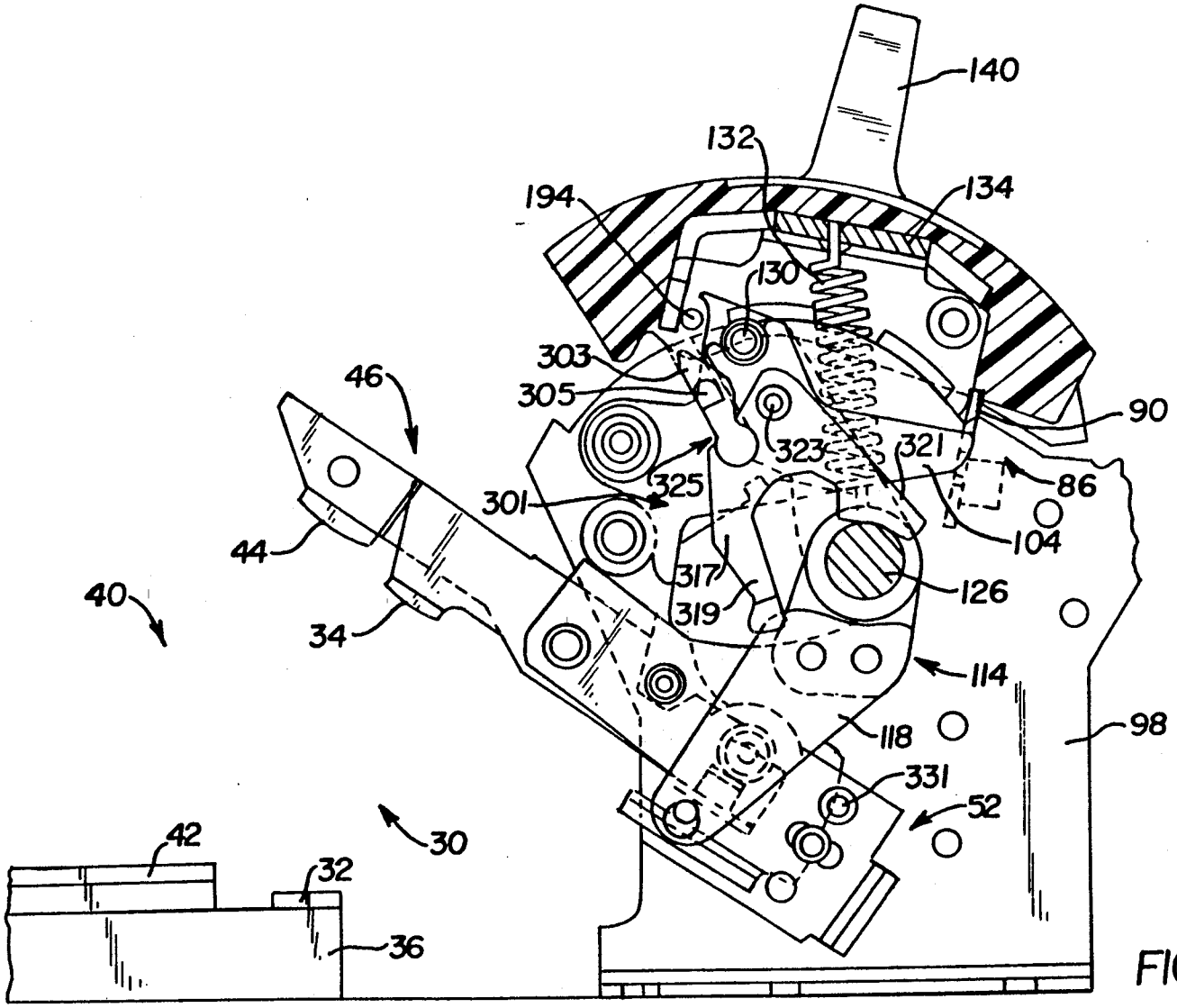
FIG. 3 is a view similar to that of FIG. 2 showing the breaker in the OFF or OPEN position.
Figure 4:
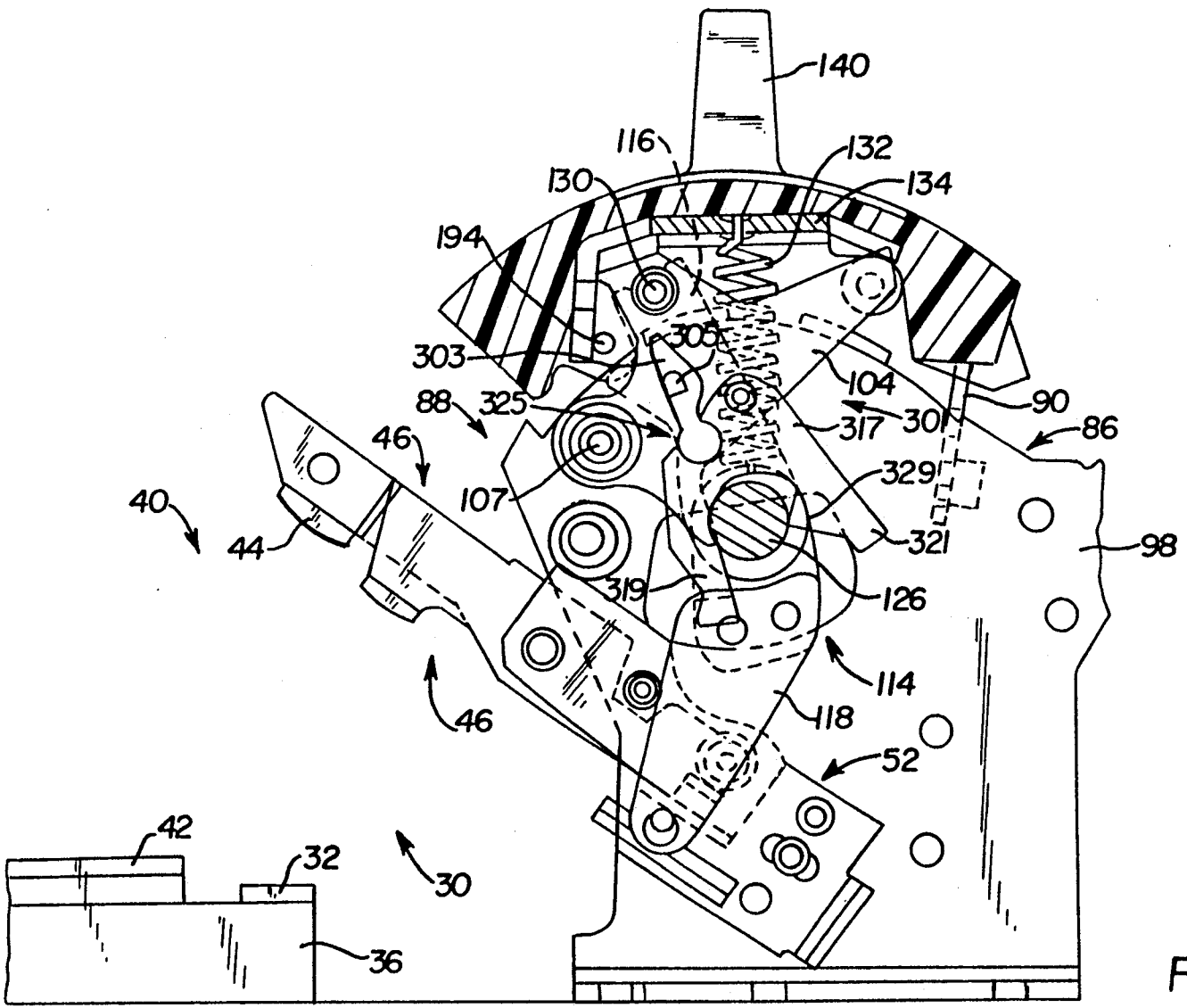
FIG. 4 is a view similar to that of FIG. 2 showing the breaker in the tripped position.

The latch assembly 86 latches the circuit breaker operating mechanism, generally identified with the reference numeral 88, during conditions when the circuit breaker 20 is in an ON position as shown in FIG. 2 and when the circuit breaker 20 is placed in an OFF position as shown in FIG. 3. However, during an overcurrent condition, the electronic trip unit 72, and more specifically, the trip bar 80 releases the latch assembly 86 to allow the circuit breaker 20 to trip as shown in FIG. 4.

The latch assembly 86 includes a pivotally mounted lock plate 90, a latch plate 92, a latch lever 94 and a biasing spring 96. The lock plate 90 is pivotally mounted to a pair of spaced apart side plates 98 (see FIG. 3), used to carry the operating mechanism 88. The latch plate 92 is coupled to the lock plate 90 at one end. The other end of the lock plate 90 is mounted for arcuate movement within the side plates 98 by pin 100 (see FIG. 2). The lock plate 90 includes a pair of spaced apart notches 102 for latching a cradle 104 which forms a portion of the operating mechanism 88 as will be discussed below in more detail. The biasing spring 96 biases the lock plate 90 and the latch plate 92 in a counterclockwise direction.

The latch lever 94 is pivotally mounted to one of the side plates 98 by way of a pin 106. The latch lever 94 is biased in a counterclockwise direction by a torsion spring (not shown). A stop pin 108 serves to limit rotation of the latch lever 94 as well as the lock plate 90.

The latch lever 94 is integrally formed with an upper latch surface 110 and a lower latch surface 112. The lower latch surface 112 is adapted to be received in a notch (not shown) in the lock plate 90 to maintain the lock plate 90 and latch plate 92 in a latched position as shown in FIG. 2. The upper latch surface 110 is adapted to communicate with the latch lever 84 formed on the trip bar 80 which releases the cradle 104 upon detection of an overcurrent condition by the electronic trip unit 72 as shown in FIG. 4. After the latch assembly 86 is unlatched, the circuit breaker handle must be moved past the OFF position as shown in FIG. 3 to reset it.

An operating mechanism 88 is provided for opening and closing the separable main contacts 30. The operating mechanism 88 includes a toggle assembly 114 which includes a pair of upper toggle links 116 (FIGS. 2–5), a pair of trip links 118 and an insulator link 120. The upper toggle link 116 is formed as an irregular shaped member having an aperture 124 for receiving a crossbar 126 (FIGS. 2–5). Each of the upper toggle links 116 is also provided with a notch 128 which allows it to be mechanically coupled to the cradle 104 by way of a pin 130 (FIGS. 2–5). Operating springs 132 are connected between the crossbar 126 and a handle yoke 134.

The cradle 104 is formed from a pair of oppositely disposed, irregular-shaped members. One end of each of the cradle members 104 is pivotally connected to each of the side plates 98 by way of the pin 107. The cradle members 104, in cooperation with the latch assembly 86 allow the circuit breaker 20 to be tripped by way of the electronic trip unit 72. More specifically, when the cradle members 104 are in the position shown in FIG. 2, the separable main contacts 30 are under the control of an extending operating handle 140, rigidly secured to the handle yoke 134 to enable the circuit breaker 20 to be placed in an OFF position as shown in FIG. 3. Similarly, the operating handle 140 may also be used to place the circuit breaker 20 in an ON position. However, upon detection of an overcurrent, the electronic trip unit 72 releases the latch assembly 86 which, in turn, releases the cradle 104 to allow the circuit breaker main contacts 30 to be tripped as shown in FIG. 4 under the influence of the operating springs 132. In order to reset the cradle 104, it is necessary to rotate the operating handle 140 past the OFF position (FIG. 3) which, in turn, allows the cradle members 104 to be latched relative to the latch assembly 86. Once the cradle members 104 are latched, the operating handle 140 may be used to place the main contacts 30 in the ON position.

Handle Yoke With Rollers

In order to conserve space within the circuit breaker housing 22, the handle yoke 134 is supported with a plurality of rollers 170 relative to the side plates 98. By supporting the handle yoke 134 with rollers 70 on the side plates 98, the virtual pivot axis for the handle yoke 134 can be maintained while at the same time allowing the same space to be used for the crossbar 126.

Referring to the drawings and in particular FIGS. 2–5, the side plates 98, which normally carry the circuit breaker operating mechanism 88, are formed with curved surfaces 172. The radius of such curved surfaces 172 is such to allow the circuit breaker 20 to accomplish all of its normal mechanical operations.

The handle yoke 134 is formed from a piece of flat steel stock, stamped and formed into a generally U-shape defining a bight portion 176 and two generally depending arm portions 178. One end of each operating spring 132 is connected to the bight portion 176. The other end of each operating spring 132 is coupled to the crossbar 126.

The depending arm portions 178 of the handle yoke 134 are disposed adjacent the curved surfaces 172 on the side plates 98. A pair of notches 192 are provided in each of the depending arm portions 178. These notches 192 allow for travel of the rollers 170 relative to the handle yoke 134. A pin 194 captured in the arms 178 of the handle yoke 134 engages and relatches the cradles 104 when the operating handle is moved beyond the off position.

Positive Off Mechanism

Figure 6:
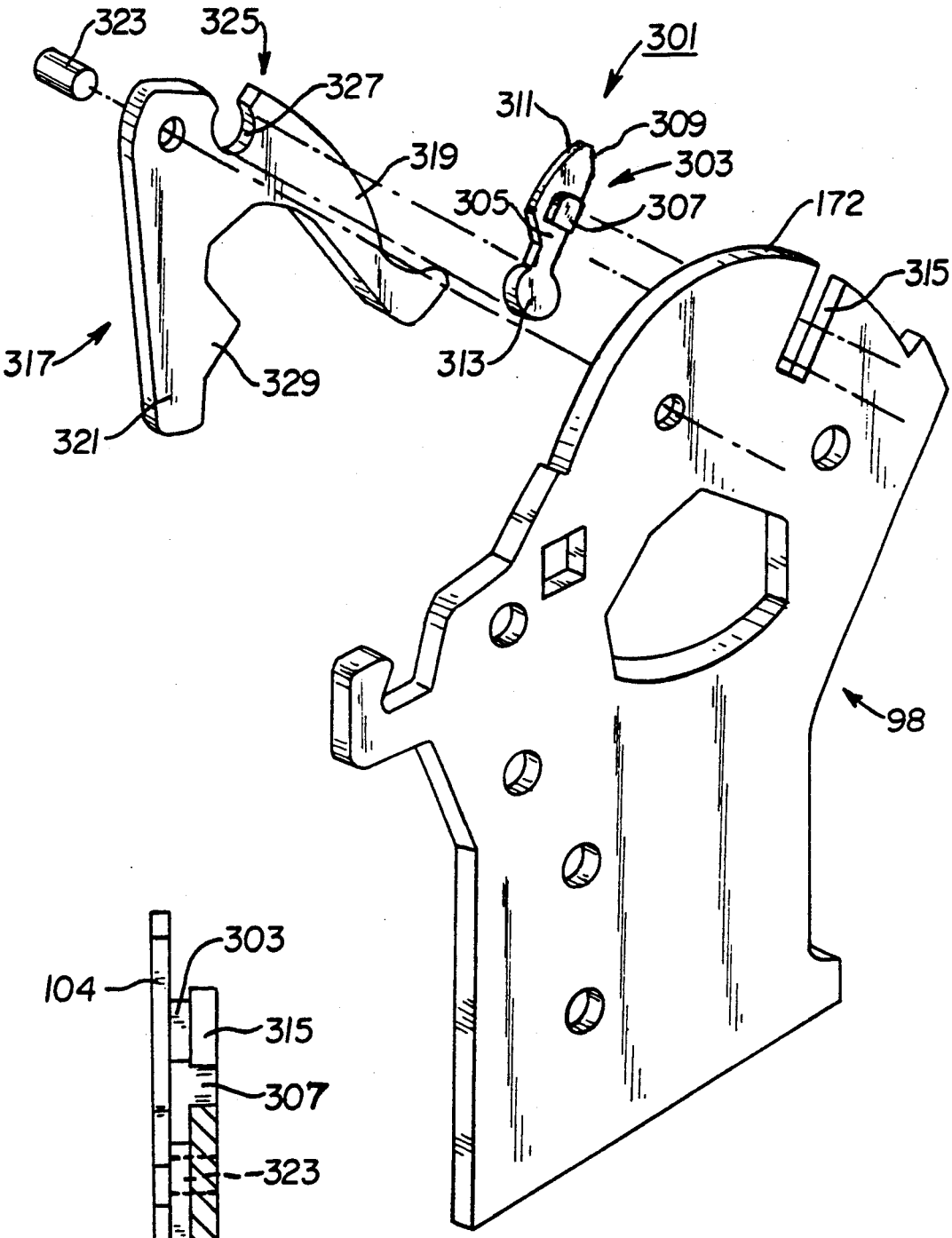
FIG. 6 is an exploded isometric view of a portion of the circuit breaker illustrating the positive off mechanism.
Figure 7:
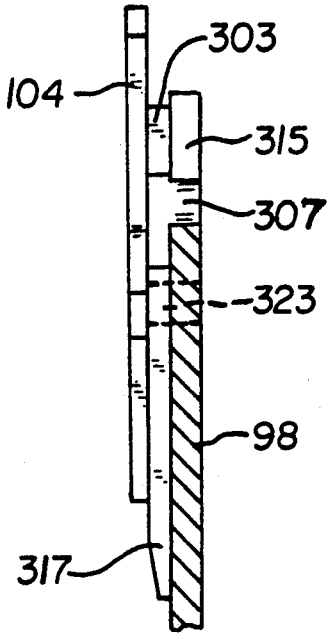
FIG. 7 is a sectional view through the parts of FIG. 6 shown assembled.

In accordance with the invention, a positive off mechanism 301 is provided to prevent the operating handle 140 from being moved to the OFF position if the main contacts are welded together. The positive off mechanism 301 includes a pair of positive off levers 303 which are best seen in FIG. 6. Each positive OFF lever 303 includes an elongated body 305 and a guide finger 307 projecting laterally from approximately the center of the elongated body. The upper ends of the elongated bodies 305 have abutment surfaces 309 and cam surfaces 311 on opposite faces for purposes to be explained. The other ends of the elongated bodies 305 terminate in circular end portions 313, which as will be seen, form part of a coupling for operating positive off levers 303.

The positive off levers 303 are mounted in the side plates 98 by engagement of the guide fingers 307 in slots 315 extending radially inward from the curved upper edge 172 of the side plates 98 upon which the handle yoke 134 moves in an arcuate path, as explained above. The positive off levers 303 are slideable along the slots 315 between an extended position in which the upper end of the elongated body member 305 carrying the abutment surface 309 and cam surface 311 projects above the curved edge 172 into the path of the pin 194 and a retracted position in which the entire elongated body 305 is below the curved radius 172 and out of the path of the handle yoke 134.

The positive OFF levers 303 are actuated between the extended and retracted positions by positive off links 317. Each of the positive off links 317 is a generally U-shaped member with two downwardly facing arms 319 and 321. The positive off links 317 are pivotally mounted on the respective side plates 98 by pivot pins 323 laterally spaced from the slots 315. A coupling 325 between the positive off levers 303 and the positive off links 317 is formed by the circular terminal portion 313 of the positive off lever 303 and a reentrant circular recess 327 in the positive off link 317 so that as the positive off link 317 is rotated about the pivot pin 323, the positive off lever 303 is extended and retracted.

The positive off links 317 in turn are operated by the toggle mechanism 114. More specifically, the arms 319 and 321 of the positive off links 317 straddle the crossbar 126 connecting the upper toggle links 116 to the lower toggle links 118.

Operation of the circuit breaker 20 is as follows. When the handle 140 is in the ON position and the cradle is latched, the center line of the springs 132 is to the left of the pin 130 so that the crossbar 126 is pulled to the left and upward as viewed in FIG. 2, thereby erecting the toggle mechanism 114. The lower toggle links 118 exert a force on the contact arm assembly 46, rotating it counter-clockwise to close the main contacts 30 and arcing contacts 40. This movement of the crossbar 126 engages the left arm 319 of the positive off links 317 thereby rotating the positive off links counter-clockwise as viewed in FIG. 2 to extend the positive off levers 303 into the path of the pin 194 in the handle yolk 134 as shown in FIG. 2.

The circuit breaker is turned off by rotating the handle 140 clockwise to the position shown in FIG. 3. When the line of action of the springs 132 passes to the right of the pin 130, the crossbar 126 is pulled upward and to the right, thereby collapsing the toggle mechanism 114. As the toggle mechanism 114 collapses, the lower toggle links 118 rotate the contact arm assembly 46 clockwise to open the main and then the arcing contacts 30, 40 as described in the related applications. As the crossbar 126 moves upward and to the right, it engages the arm 321 of the positive off links 317 to rotate the positive off links counter-clockwise, thereby retracting the positive off lever 303 out of the path of the pin 194 as shown in FIG. 3. The spacing between the pin 194 with the handle in the 0N position and the positive off levers 303 is sufficient that the positive off levers are retracted before the pin 194 reaches the slots 315 in the side plates 98 during opening.

When the circuit breaker is in the ON position and is tripped, the cradle 104 is unlatched by the latch assembly 86 and rotated in a counter-clockwise direction by the springs 132. When the pin 130 carried by the cradle passes to the left of the line of action of the springs 132, the toggle mechanism 114 again collapses. The movement of the crossbar 126 is more in an upward direction when the circuit breaker is tripped rather than being turned off because of the translation of the pin 130 carried by the unlatched cradle 104. Accordingly, a projection 329 is provided on the arm 321 to engage the cross bar for retraction of the positive off lever when the circuit breaker is tripped. The circuit breaker is shown in the tripped condition in FIG. 4.

Figure 5:
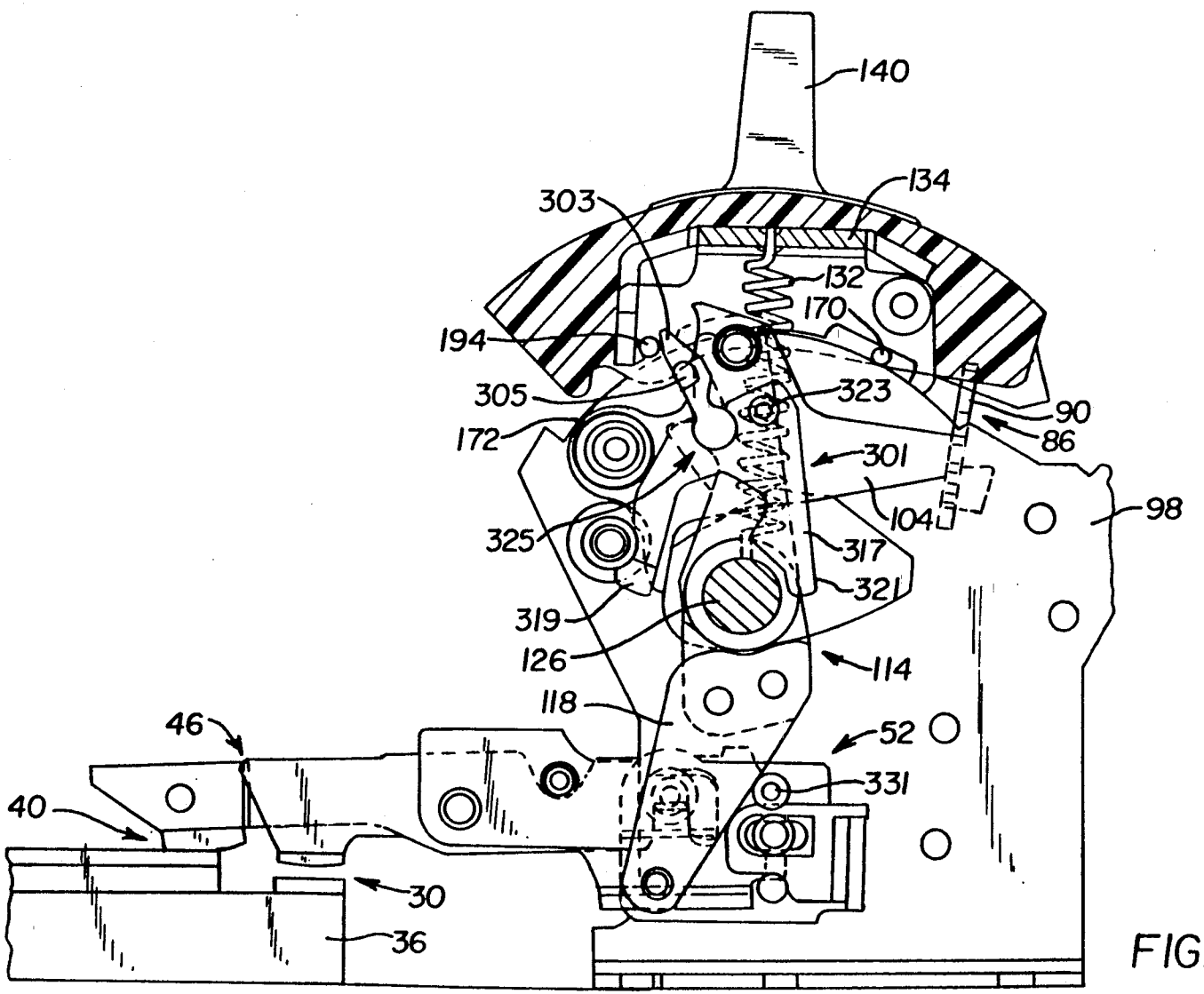
FIG. 5 is a view similar to that of FIG. 2 showing the breaker during an attempt to turn the breaker off with the contacts welded closed.

When the contacts become welded closed, the toggle mechanism 114 remains erect if the breaker is tripped or an attempt is made to move the handle to the OFF position. This condition is illustrated in FIG. 5. With the toggle mechanism 114 in the erected position, the positive off levers 303 are maintained in their extended position. Thus, if an attempt is made to move the handle clockwise to the off position, the path of the pin 194 is blocked by the positive off levers. As seen in FIG. 5, the handle can be moved to a position where the line of action of the springs 132 is just over the pin 130. However, the handle will not stay in this position when it is released and will return to the on position to provide a positive indication of the closed contacts. With the handle in this over toggle position, the springs 132 apply a force tending to break the welded contacts open. This may not be sufficient to break the weld, however.

As mentioned above, some of the prior art positive off mechanisms could be defeated by the application of excessive force to the handle which resulted in deflection of the parts. The positive off mechanism 301 of the invention is not subject to such deflections, because it operates directly on the handle yoke 134. The positive off levers 303 are seated in and guided by the rigid side plates 98 and directly engage the handle retaining pin 194 without long lever arms which could be subject to deflection. In order to assure that the toggle mechanism 114 remains fully erected when the contacts are welded closed, pins 331 are provided on the sides of the carrier assembly 52 to prevent any excess motion of the lower toggle links 118 which might allow the positive off levers to be partially retracted and to assure the handle does not go overtoggle.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker comprising:

a housing;

one or more pairs of separable contacts mounted in said housing;

an operating mechanism operatively coupled to said one or more pairs of separable contacts;

a pair of side plates mounted in said housing and supporting said operating mechanism;

a handle assembly operatively coupled to said operating mechanism and selectively movable reciprocally along a path between an on position in which said separable contacts are closed by said operating mechanism and an off position in which said separable contacts are opened by said operating mechanism; and positive off means comprising:

least one positive off lever slidable in a slot in one of said side plates between an extended position in which said positive off lever extends into said path of said handle assembly and blocks movement of said handle assembly toward said off position, and a retracted position in which said handle assembly is free to move to said off position; and actuating means coupled to said operating mechanism actuating said positive off lever to said extended position to block movement of said handle assembly to said off position when said separable contacts are welded closed.

2. The circuit breaker of claim 1 wherein said operating mechanism includes a toggle mechanism which is erect when said separable contacts are closed and is collapsed when said separable contacts are open, and wherein said actuating means comprises a positive off link which is actuated by said toggle mechanism to extend said positive off lever to the extended position when said toggle mechanism is erect, said toggle mechanism remaining erect when said separable contacts are welded closed.

3. The circuit breaker of claim 2 wherein said toggle mechanism includes at least one pair of toggle links and a cross bar pivotally connecting said pair of toggle links, and wherein said positive off link is pivotally mounted for rotation by said cross bar to extend said positive off lever when said toggle mechanism is erect and to retract said positive off lever when said toggle mechanism collapses.

4. The circuit breaker of claim 3 wherein said positive off link has a pair of spaced apart arms straddling said cross bar with one of said arms being engaged by said cross bar to rotate said positive off link to extend said positive off lever as said toggle mechanism is erected, and the other arm being engaged by said cross bar to rotate said positive off link to retract said positive off lever as said toggle mechanism collapses.

5. The circuit breaker of claim 4 wherein said cross bar moves a predetermined distance before said toggle mechanism collapses from said erect position, and wherein said arms of said positive off link are spaced apart by at least said predetermined distance.

6. The circuit breaker of claim 5 wherein said separable contacts include a fixed contact and a movable contact carried by a movable contact arm assembly, wherein said pair of toggle links includes a lower toggle link pivotally connected to said movable contact arm assembly, and wherein said movable contact arm assembly includes a projection engaging and limiting rotation of said lower toggle link relative to said movable contact arm assembly with said separable contacts welded closed.

7. The circuit breaker of claim 6 including a trip mechanism operatively coupled to said operating mechanism to operate said operating mechanism to open said separable contacts in response to predetermined current conditions, said cross bar moving to a trip position as said toggle mechanism collapses when said operating mechanism is operated by said trip mechanism, and wherein said other arm on said positive off link has a trip surface engaged by said cross bar in said trip position to rotate said positive off link to retract said positive off lever.

8. The circuit breaker of claim 3 wherein said separable contacts include a fixed contact and movable contact carried by a movable contact arm assembly, wherein said pair of toggle links includes a lower toggle link pivotally connected to said movable contact arm assembly, and wherein said movable contact arm assembly includes a projection engaging and limiting rotation of said lower toggle link relative to said movable contact arm assembly with said separable contacts welded closed.

9. The circuit breaker of claim 8 wherein said handle assembly toggles to an off position when said handle assembly reaches a toggle position after said toggle mechanism collapses to open said separable contacts and wherein said projection on said movable contact assembly limits rotation of said lower toggle link sufficiently to prevent said handle assembly from reaching said toggle position when said separable contacts are welded closed.

10. The circuit breaker of claim 1 wherein said actuating means comprises a positive off link, and a pivot pin supported in said side plate and laterally off set from said slot pivotally supporting said positive off link, and coupling means coupling said positive off lever to said positive off link for movement of said positive off lever between said extended and retracted positions by rotation of said positive off link about said pivot pin by said operating mechanism.

11. The circuit breaker of claim 10 wherein said coupling means includes a circular reentrant recess in said positive off link and a projection on said positive off lever with an enlarged arcuate terminal portion which is captured for rotation in said circular reentrant recess.

12. A circuit breaker comprising:

a housing;

one or more pairs of separable main contacts mounted in said housing each including a fixed contact and a movable contact mounted on a movable contact arm assembly;

an operating mechanism including a toggle mechanism having a pair of toggle links pivotally connected by a cross-bar and pivotally connected by one of said toggle links to said movable contact arm assembly, said toggle mechanism having an erect position in which said separable contacts are closed and a collapsed position in which said separable contacts are open;

a pair of side plates mounted in said housing and supporting said operating mechanism;

a handle assembly operatively coupled to said operating mechanism and selectively movable reciprocally along a path between an on position in which said separable main contacts are closed by said operating mechanism, and an off position in which said separable contacts are opened by said operating mechanism; and positive off means comprising:

at least one positive off lever slidable in a slot in one of said side plates between an extended position in which said positive off lever extends into said path of said handle assembly and blocks movement of said handle assembly towards said off position and a retracted position in which said handle assembly is free to move to said off position;

a positive off link, and a pivot pin supported in said side plate and laterally offset from said slot pivotally supporting said positive off link;

coupling means coupling said positive off lever to said positive off link for movement of said positive off lever between said extended and retracted positions by rotation of said positive off link about said pivot pin by said operating mechanism; and a projection on said movable contact arm assembly limiting pivoting of said one toggle links relative to said movable contact arm assembly with said separable contacts welded closed.

13. The circuit breaker of claim 12 wherein said coupling means comprises a circular reentrant recess in said positive off link and a projection on said positive off lever with an enlarged arcuate portion which is captured for rotation in said circular reentrant recess.

* * * * *